US008069996B2

(12) United States Patent
Wu

(10) Patent No.: US 8,069,996 B2
(45) Date of Patent: Dec. 6, 2011

(54) GARDENING TOOL SUSPENSION DEVICE

(75) Inventor: Shih-Piao Wu, Changhua Hsien (TW)

(73) Assignee: Jiin Haur Industrial Co., Ltd., Changhua Hsien (TW)

( * ) Notice: Subject to any disclaimer, the term of this patent is extended or adjusted under 35 U.S.C. 154(b) by 225 days.

(21) Appl. No.: 12/638,099

(22) Filed: Dec. 15, 2009

(65) Prior Publication Data

US 2011/0139737 A1 Jun. 16, 2011

(51) Int. Cl.
*A47F 7/00* (2006.01)

(52) U.S. Cl. ..... 211/70.6; 206/349; 206/477; 411/526; 411/533

(58) Field of Classification Search ..... 211/70.6, 211/4, 86.01; 248/689; 206/349, 477, 481; 411/533, 526

See application file for complete search history.

(56) References Cited

U.S. PATENT DOCUMENTS 3,893,221 A * 7/1975 Lehmann ..... 29/453
4,650,074 A * 3/1987 Vosbikian ..... 206/477
4,812,094 A * 3/1989 Grube ..... 411/134
5,967,724 A * 10/1999 Terry ..... 411/149
6,375,005 B1 * 4/2002 McCann ..... 206/349
6,464,840 B1 * 10/2002 McCann ..... 206/349
7,527,150 B2 * 5/2009 Tong ..... 206/376
2005/0035013 A1 * 2/2005 Bates et al. ..... 206/349

* cited by examiner

*Primary Examiner* — Darnell Jayne
*Assistant Examiner* — Stanton L Krycinski
(74) *Attorney, Agent, or Firm* — Alan Kamrath; Kamrath & Associates PA

(57) ABSTRACT

A gardening tool suspension device includes a suspension rack (20) having a through hole (22), a gardening tool (10) mounted on the suspension rack and a fastening mechanism (30) mounted on the suspension rack and locked onto the gardening tool to attach the gardening tool to the suspension rack. The gardening tool include two handles (13) pivotally connected by a threaded pivot shaft (12). The fastening mechanism includes a locking nut (31) screwed onto the pivot shaft and having a flange (311) extending through the through hole, and a retaining ring (32) locked onto the flange of the locking nut. Thus, only the locking nut is locked by the retaining ring so that the two handles of the gardening tool are not limited and can be pivoted freely, thereby facilitating a consumer operating the gardening tool.

3 Claims, 5 Drawing Sheets

GARDENING TOOL SUSPENSION DEVICE

BACKGROUND OF THE INVENTION

1. Field of the Invention

The present invention relates to a suspension device and, more particularly, to a gardening tool suspension device for an exhibition purpose.

2. Description of the Related Art

A conventional gardening tool suspension device comprises a support board and an elongate flexible clamping strap. The support board is provided with two through holes. The clamping strap has a first end provided with an insert and a second end provided with a limit head. The insert of the clamping strap has a side provided with a plurality of oneway locking teeth. The limit head of the clamping strap has an inner portion provided with a passage. The passage of the limit head has a side provided with a locking detent.

In assembly, the insert of the clamping strap initially extends through one of the two through holes of the support board, then encompasses a gardening tool, then extends through the other one of the two through holes of the support board, and finally extends through the passage of the limit head to combine with the limit head of the clamping strap so that the clamping strap forms a loop so as to clamp the gardening tool between the clamping strap and the support board. At this time, the locking teeth of the clamping strap are locked by the locking detent of the limit head so that the gardening tool is clamped and tightened between the clamping strap and the support board.

However, the insert of the clamping strap needs to in turn extend through one of the two through holes of the support board, surround the gardening tool, extend through the other one of the two through holes of the support board, and extends through the passage of the limit head so as to clamp the gardening tool between the clamping strap and the support board, so that the clamping strap is not combined with the support board easily and quickly, thereby greatly causing inconvenience to a user when clamping the tool between the clamping strap and the support board. In addition, the two handles of the gardening tool are limited by the clamping strap so that the two handles of the gardening tool cannot be pivoted and moved freely to open or close the blade portions of the two handles, thereby causing inconvenience to a consumer when he/she wishes to operate the gardening tool.

BRIEF SUMMARY OF THE INVENTION

In accordance with the present invention, there is provided a gardening tool suspension device, comprising a suspension rack, a gardening tool mounted on a first face of the suspension rack, and a fastening mechanism mounted on a second face of the suspension rack and locked onto the gardening tool to attach the gardening tool to the suspension rack.

The gardening tool include two handles pivotally connected with each other by a threaded pivot shaft. Each of the two handles of the gardening tool has a distal end provided with a blade portion. The suspension rack has a mediate portion provided with a through hole and an upper portion provided with a hanging hole. The fastening mechanism includes a locking nut screwed onto the pivot shaft of the gardening tool and having a first side abutting the gardening tool and a second side abutting the first face of the suspension rack and provided with a reduced flange extending through the through hole of the suspension rack and a retaining ring abutting the second face of the suspension rack and locked onto the flange of the locking nut. The flange of the locking nut of the fastening mechanism has a periphery provided with a locking groove. The flange of the locking nut protrudes outwardly from the gardening tool. The retaining ring of the fastening mechanism has a size greater than that of the through hole of the suspension rack. The retaining ring of the fastening mechanism has an inner wall provided with a plurality of barb-shaped locking claws snapped into and locked in the locking groove of the locking nut. Each of the locking claws of the retaining ring is inclined toward the flange of the locking nut and has the same inclined angle.

According to the primary objective of the present invention, the locking nut on the pivot shaft of the gardening tool is locked by the retaining ring so as to attach the gardening tool to the suspension rack solidly and stably.

According to another objective of the present invention, the retaining ring is directly snapped onto the locking nut to position the gardening tool without needing a clamping strap to tighten the gardening tool so that the gardening tool is attached to the suspension rack easily and quickly.

According to a further objective of the present invention, only the locking nut is locked by the retaining ring so that the two handles of the gardening tool are not limited and can be pivoted and moved freely to open and close the blade portions of the two handles, thereby facilitating a consumer operating the gardening tool.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
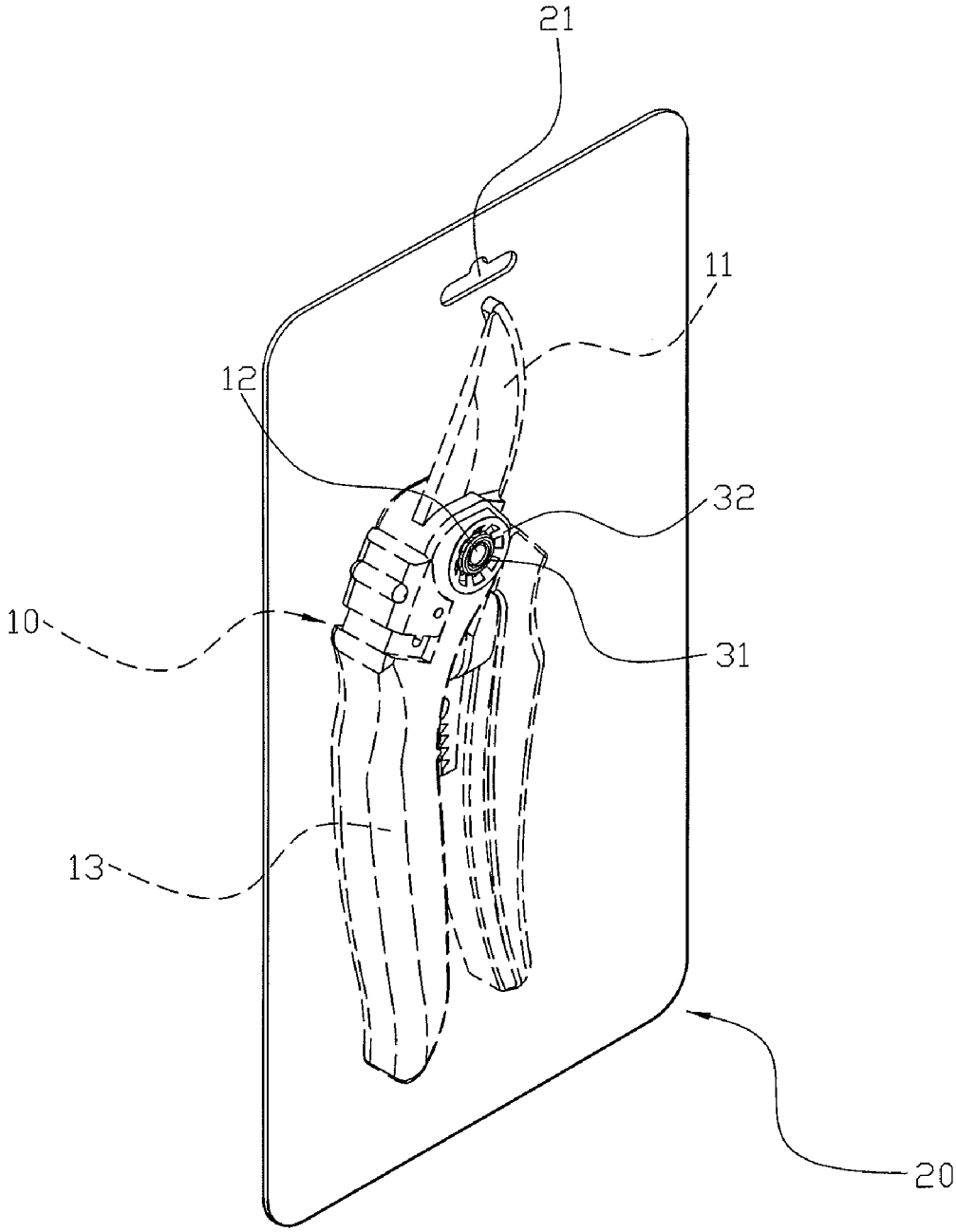
FIG. 1 is a perspective view of a gardening tool suspension device in accordance with the preferred embodiment of the present invention.
Figure 2:
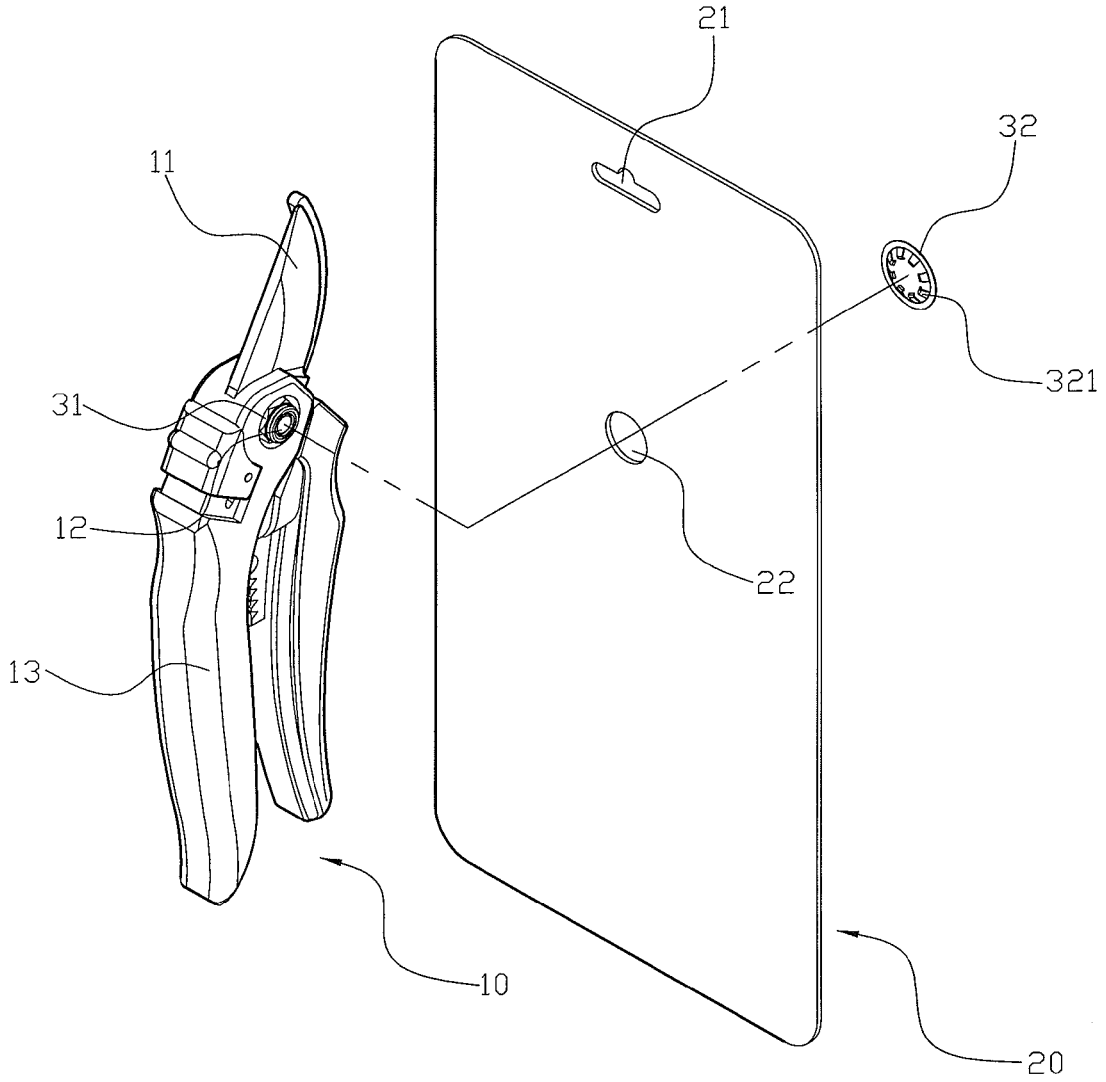
FIG. 2 is an exploded perspective view of the gardening tool suspension device as shown in FIG. 1.
Figure 3:
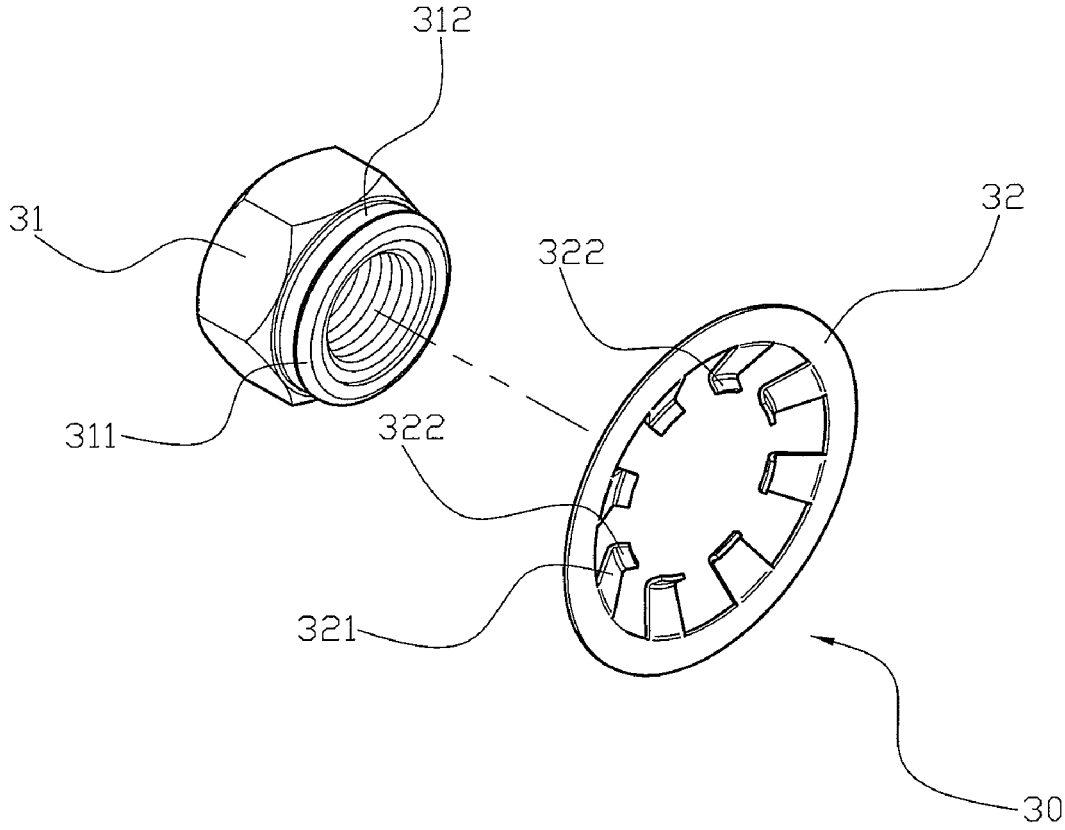
FIG. 3 is an exploded perspective view of a fastening mechanism of the gardening tool suspension device as shown in FIG. 1.
Figure 4:
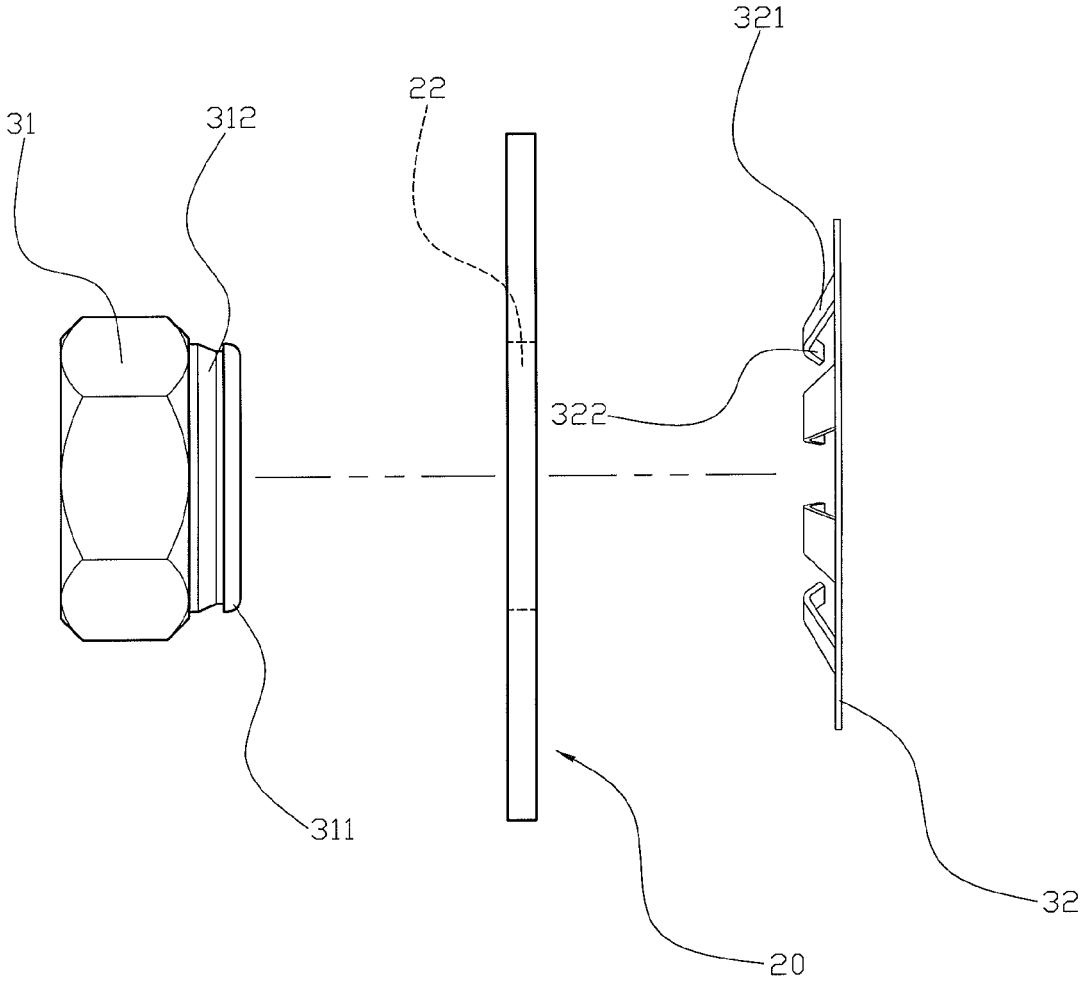
FIG. 4 is a side exploded view of the gardening tool suspension device as shown in FIG. 1.
Figure 6:
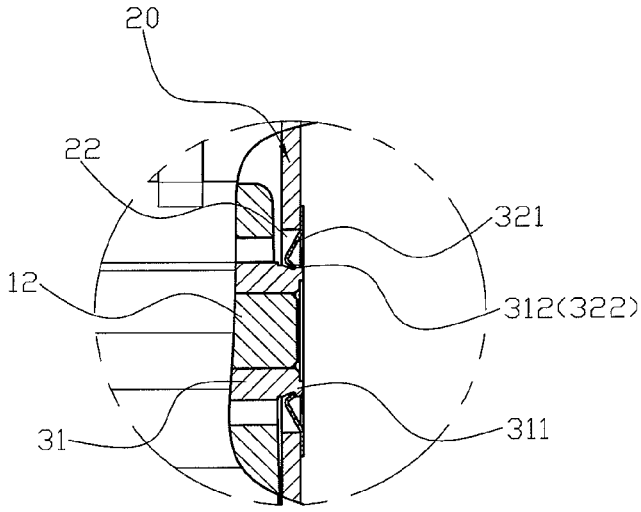
FIG. 6 is a locally enlarged view of the gardening tool suspension device as shown in FIG. 5.
Figure 5:
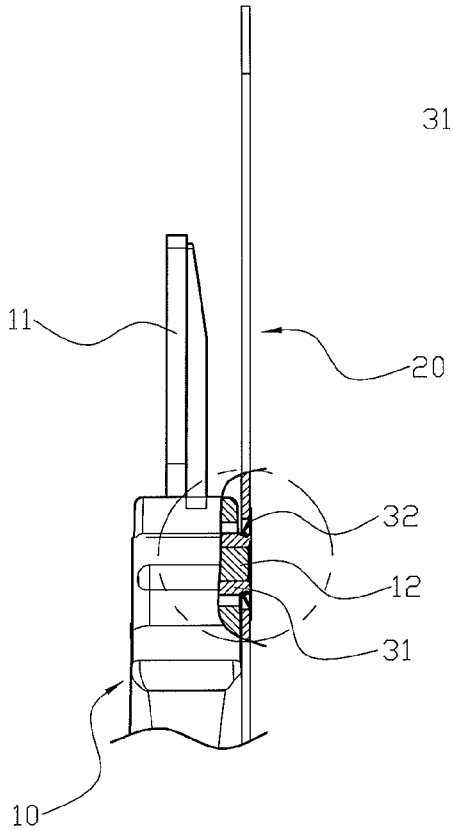
FIG. 5 is a partially side cross-sectional view of the gardening tool suspension device as shown in FIG. 1.

Referring to FIGS. 1-6, a gardening tool suspension device in accordance with the preferred embodiment of the present invention comprises a suspension rack 20, a gardening tool 10 mounted on a first face of the suspension rack 20 and a fastening mechanism 30 mounted on a second face of the suspension rack 20 and locked onto the gardening tool 10 to attach the gardening tool 10 to the suspension rack 20.

The gardening tool 10 include two handles 13 pivotally connected with each other by a threaded pivot shaft 12. Each of the two handles 13 of the gardening tool 10 has a distal end provided with a blade portion 11.

The suspension rack 20 has a mediate portion provided with a through hole 22 and an upper portion provided with a hanging hole 21.

The fastening mechanism 30 includes a locking nut 31 screwed onto the pivot shaft 12 of the gardening tool 10 and having a first side abutting the gardening tool 10 and a second side abutting the first face of the suspension rack 20 and provided with a reduced flange 311 extending through the through hole 22 of the suspension rack 20 and a retaining ring 32 abutting the second face of the suspension rack 20 and locked onto the flange 311 of the locking nut 31.

The flange 311 of the locking nut 31 of the fastening mechanism 30 has a periphery provided with a locking groove 312. The retaining ring 32 of the fastening mechanism 30 has an inner wall provided with a plurality of barb-shaped locking claws 321 snapped into and locked in the locking groove 312 of the locking nut 31. The locking claws 321 of the retaining ring 32 extend radially and inwardly from the inner wall of the retaining ring 32 and are arranged in a radiating manner. The locking claws 321 of the retaining ring 32 are spaced from each other, and each of the locking claws 321 of the retaining ring 32 is made flexible. Each of the locking claws 321 of the retaining ring 32 is inclined toward the flange 311 of the locking nut 31 and has the same inclined angle. Each of the locking claws 321 of the retaining ring 32 has a distal end provided with a bent limit portion 322 which is directed outwardly relative to the flange 311 of the locking nut 31 and is locked in the locking groove 312 of the locking nut 31.

The locking nut 31 of the fastening mechanism 30 has a size greater than that of the through hole 22 of the suspension rack 20. The flange 311 of the locking nut 31 protrudes outwardly from the gardening tool 10 and has a size smaller than that of the through hole 22 of the suspension rack 20. The retaining ring 32 of the fastening mechanism 30 has a size greater than that of the through hole 22 of the suspension rack 20. The locking claws 321 of the retaining ring 32 are extended into the through hole 22 of the suspension rack 20.

In assembly, the flange 311 of the locking nut 31 is inserted through the through hole 22 of the suspension rack 20. Then, the retaining ring 32 is pressed toward the flange 311 of the locking nut 31 to press the locking claws 321 of the retaining ring 32 radially and outwardly. After the locking claws 321 of the retaining ring 32 align with the locking groove 312 of the locking nut 31, the locking claws 321 of the retaining ring 32 are expanded radially and inwardly by their resilience and are locked in the locking groove 312 of the locking nut 31 so as to combine the retaining ring 32 with the locking nut 31. In such a manner, the locking nut 31 is locked by the retaining ring 32 so as to attach the gardening tool 10 to the suspension rack 20.

When in use, the hanging hole 21 of the suspension rack 20 is hung on a support frame so as to hang the gardening tool 10 on the support frame for display and exhibition. In such a manner, the suspension rack 20 has two opposite faces each provided with colors, figures, patterns and specifications to enhance the versatility of the gardening tool 10. In addition, the locking nut 31 is locked by the retaining ring 32 to attach the gardening tool 10 to the suspension rack 20 so that the two handles 13 of the gardening tool 10 are not limited and can be pivoted and moved freely to open and close the blade portions 11 of the two handles 13, thereby facilitating a consumer operating the gardening tool 10.

Accordingly, the locking nut 31 on the pivot shaft 12 of the gardening tool 10 is locked by the retaining ring 32 so as to attach the gardening tool 10 to the suspension rack 20 solidly and stably. In addition, the retaining ring 32 is directly snapped onto the locking nut 31 to position the gardening tool 10 without needing a clamping strap to tighten the gardening tool 10 so that the gardening tool 10 is attached to the suspension rack 20 easily and quickly. Further, only the locking nut 31 is locked by the retaining ring 32 so that the two handles 13 of the gardening tool 10 are not limited and can be pivoted and moved freely to open and close the blade portions 11 of the two handles 13, thereby facilitating a consumer operating the gardening tool 10.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A gardening tool suspension device, comprising:

a suspension rack (20);

a gardening tool (10) mounted on a first face of the suspension rack; and a fastening mechanism (30) mounted on a second face of the suspension rack and locked onto the gardening tool to attach the gardening tool to the suspension rack;

the gardening tool includes two handles (13) pivotally connected with each other by a threaded pivot shaft (12);

each of the two handles of the gardening tool has a distal end provided with a blade portion (11);

the suspension rack has a mediate portion provided with a through hole (22) and an upper portion provided with a hanging hole (21);

the fastening mechanism includes:

a locking nut (31) screwed onto the pivot shaft of the gardening tool and having a first side abutting the gardening tool and a second side abutting the first face of the suspension rack and provided with a reduced flange (311) extending through the through hole of the suspension rack; and a retaining ring (32) abutting the second face of the suspension rack and locked onto the flange of the locking nut;

the flange of the locking nut of the fastening mechanism has a periphery provided with a locking groove (312);

the flange of the locking nut protrudes outwardly from the gardening tool;

the retaining ring of the fastening mechanism has a size greater than that of the through hole of the suspension rack;

the retaining ring of the fastening mechanism has an inner wall provided with a plurality of barb-shaped locking claws (321) snapped into and locked in the locking groove of the locking nut;

each of the locking claws of the retaining ring is inclined toward the flange of the locking nut and has the same inclined angle.

2. The gardening tool suspension device of claim 1, wherein the suspension rack has two opposite faces each provided with colors, figures, patterns and specifications.

3. The gardening tool suspension device of claim 1, wherein the locking claws of the retaining ring extend radially and inwardly from the inner wall of the retaining ring and are arranged in a radiating manner.

* * * * *